US007970336B2

(12) United States Patent
Sakashita et al.

(10) Patent No.: US 7,970,336 B2
(45) Date of Patent: Jun. 28, 2011

(54) POWDER HOUSING UNIT AND IMAGE FORMING APPARATUS WITH POWDER HOUSING UNIT

(75) Inventors: Takeshi Sakashita, Osaka (JP); Tomofumi Inoue, Osaka (JP); Takeru Muramatsu, Ibaraki (JP); Kohji Hatayama, Kanagawa (JP); Mitsutoshi Kichise, Osaka (JP); Yuuji Meguro, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 677 days.

(21) Appl. No.: 12/010,797

(22) Filed: Jan. 30, 2008

(65) Prior Publication Data

US 2008/0187365 A1 Aug. 7, 2008

(30) Foreign Application Priority Data

Feb. 5, 2007 (JP) ..... 2007-026031
Apr. 27, 2007 (JP) ..... 2007-119205

(51) Int. Cl.
*G03G 21/00* (2006.01)

(52) U.S. Cl. ..... 399/359; 399/119; 399/120; 399/254; 399/263

(58) Field of Classification Search ..... 399/119, 399/120, 254, 263, 359
See application file for complete search history.

(56) References Cited

U.S. PATENT DOCUMENTS

| | | | | |
|---|---|---|---|---|
| 6,246,854 | B1 * | 6/2001 | Kurosawa et al. | 399/263 |
| 2006/0067735 | A1 * | 3/2006 | Sanada et al. | 399/120 |
| 2007/0264051 | A1 * | 11/2007 | Tanaka | 399/254 |

FOREIGN PATENT DOCUMENTS

| | | | |
|---|---|---|---|
| JP | 05-204281 | | 8/1993 |
| JP | 05-313542 | | 11/1993 |
| JP | 06222671 | A * | 8/1994 |
| JP | 08-211817 | | 8/1996 |
| JP | 10-069195 | | 3/1998 |
| JP | 11-002947 | | 1/1999 |
| JP | 11-327275 | | 11/1999 |
| JP | 2006-011232 | | 1/2006 |
| JP | 2006-031006 | | 2/2006 |
| JP | 2006-091321 | | 4/2006 |
| JP | 2006-168894 | | 6/2006 |
| JP | 2006-171608 | | 6/2006 |

OTHER PUBLICATIONS

English Abstract of JP 06222671 A to Sato et al.*

* cited by examiner

*Primary Examiner* — Ryan D Walsh
(74) *Attorney, Agent, or Firm* — Harness, Dickey & Pierce, P.L.C.

(57) ABSTRACT

A powder housing unit includes a plate-shaped agitating unit that is horizontally arranged inside of a casing to accommodate a powder, a rotating shaft that causes the agitating unit to slide back and forth, and a powder conveying unit that conveys the powder in a horizontal direction during the sliding. The rotating shaft is supported by a shaft supporting unit in a rotatable manner such that a space is formed between the rotating shaft and the shaft supporting unit.

19 Claims, 14 Drawing Sheets

POWDER HOUSING UNIT AND IMAGE FORMING APPARATUS WITH POWDER HOUSING UNIT

CROSS-REFERENCE TO RELATED APPLICATIONS

The present application claims priority to and incorporates by reference the entire contents of Japanese priority documents, 2007-026031 filed in Japan on Feb. 5, 2007 and 2007-119205 filed in Japan on Apr. 27, 2007.

BACKGROUND OF THE INVENTION

1. Field of the Invention

The present invention relates to an image forming apparatus and a powder housing unit for use in the image forming apparatus.

2. Description of the Related Art

In image forming apparatuses, e.g., copiers, a residual toner remained on a photosensitive drum or an intermediate transfer belt after transfer of a toner image onto a recording medium or an intermediate member is removed by a cleaning mechanism, and then conveyed to a toner collection box. Thus, the residual toner is gathered together and accumulates in the toner collection box.

A typical toner collection box includes a toner inlet portion that is connected to the cleaning mechanism, a toner conveying unit that conveys the toner coming in the toner conveying unit that conveys the toner coming in the toner collection box to further inside the toner collection box, and a toner-amount monitoring unit that monitors a filling factor indicative of a ratio of the current toner amount to the allowable toner amount in the toner collection box. When the current toner amount reaches the allowable toner amount, i.e., when the toner collection box is full, the toner collection box must be replaced with an empty one.

From the viewpoint of usability, it is preferable to decrease a frequency of replacing the toner collection box. A toner collection box having a larger capacity is suitable in respect of replacement frequency.

More and more small-sized and lower-cost image forming apparatuses have been produced recently. Therefore, it is impractical to use a toner collection box having a large capacity; because a toner collection box having a large capacity increases the overall size of an image forming apparatus.

Generally, a toner collection box is arranged in a dead space in an image forming apparatus, i.e., a space between a feeding unit that is arranged on a bottom of a main body of the image forming apparatus and an image forming unit that is arranged above the feeding unit.

A toner collection box disclosed in Japanese Patent Application Laid-open No. 11-002947 includes a toner conveying unit inside a box-shaped toner cartridge. In this toner collection box, an eccentric cam is attached to a screw shaft that is used for supplying a toner to an outside unit. The eccentric cam causes a plate having projections to horizontally slide back and forth. The projections extend obliquely upward approaching each other and move the toner as the plate slide. A mechanism for sensing a remaining toner-amount is also arranged inside the cartridge.

It is required to ensure a smooth supply of toner to the developing device for avoiding an insufficient toner supply. However, if there is a block of toner in the toner collection box, the block of toner can inhibit the smooth supply. Japanese Patent Application Laid-open No. H05-204281 discloses a mechanism for breaking a block of toner into pieces.

In this mechanism, a Mylar film having a pressure-resistance is provided on a portion near an outlet of toner from the screw shaft such that the Mylar film comes in contact with the falling toner. A square rod is arranged such that it comes in contact with the Mylar film. When the square rod rotates, the Mylar film vibrates thereby pushing an upper portion of the accumulated toner downward, i.e., leveling a hill of toner off. As a result it is possible to prevent blocking of toner, and facilitate spreading of the toner.

Japanese Patent Application Laid-open No. H11-002947 discloses a technique to use all toner within the cartridge, i.e., remove all toner from the cartridge by not producing a block of toner. As shown in FIG. 7 of Japanese Patent Application Laid-open No. H11-002947, although toner conveying directions at the pairs of projections extending obliquely upward approaching each other are variable crossing to each other, the toner conveying directions interact with each other to generate a one-way toner conveying direction toward the toner-amount sensing unit. In the mechanism disclosed in Japanese Patent Application Laid-open No. H11-002947, the eccentric cam causes the plate to horizontally slide back and forth so that the toner is conveyed on the plate. The mechanism requires a shaft supporting unit for supporting a rotating shaft attached with the eccentric cam and a plate supporting unit for supporting the plate.

In some cases, the shaft supporting unit is arranged inside the toner collection box for saving the space. The plate supporting unit is, of course, arranged inside the toner collection box. A passage member through which a rotating shaft is arranged is one of simple supporting units that can be replaced with a complicated ball bearing. If a casing of the toner collection box is made by resin molding, such a passage can be formed on a portion of the casing for positioning and supporting of the rotating shaft. The rotating shaft is arranged passing through the passage.

FIGS. 32A and 32B are side views of an exemplary shaft supporting unit 101 that is arranged inside the toner collection box. A cross section orthogonal to a rotation axis is shown. A casing 100 of the toner collection box has two portions, upper and lower, and they are made by resin molding. As shown in FIG. 32A, a passage 100A through which the rotating shaft 101 is passed such that an outer circumference of the rotating shaft 101 engages therewith is formed between the upper portion and the lower portion. As shown in FIG. 32B, a passage 100A' includes a holding member on the upper portion of the casing 100. A lower circumference of the rotating shaft 101 engages with a part of the passage 100A' that is on the lower portion, and an upper circumference of the rotating shaft 101 engages with the holding member.

To support the plate, it is possible to form a projection on the plate such that it presses against a bottom of the toner collection box. A supporting unit that extends upward from the bottom of the toner collection box such that the head thereof supports the plate can be used instead of the projection.

The conventional shaft supporting unit supports the rotating shaft in a rotatable manner with a minimum gap between the shaft supporting unit and the rotating shaft. The minimum gap is appropriate for positioning of the rotating shaft. However, the gap is so small that a toner once caught between the shaft supporting unit and the rotating shaft can hardly go out. The toner remained on a bearing makes the gap between the outer circumference of the rotating shaft and a bearing surface uneven, and the uneven gap can cause vibration of the rotating shaft, which can generate noise and abnormal noise.

If a toner is caught between sliding surface of the plate and the plate supporting unit, the toner can causes vibration of the plate, which can generate noise and abnormal noise.

The cause of vibration of the rotating shaft thereby generating noise and abnormal noise is not only the toner remained on the bearing surface. The supporting units can vibrate along with the vibration of the rotating shaft thereby generating noise and abnormal noise.

Most of image forming apparatuses, for example, copying machines, printers, facsimiles, and multifunction products include a cleaning mechanism that removes a residual toner remained on an image carrier after a toner image on the image carrier is transferred onto a paper and a toner conveying unit that conveys the residual toner to the powder housing unit.

For example, Japanese Patent Application Laid-open No. 2006-31006 discloses a powder housing unit that includes inside its casing an agitating mechanism that agitates toners for efficient accommodation. The agitating mechanism includes an agitating plate that is arranged inside the casing, a shaft that extends from the agitating plate to outside of the toner collection unit passing through the casing, a cam member that comes in contact with one end of the shaft, a spring that presses the end of the shaft against the cam member, and a cam driving gear. The cam member rotates to cause the shaft to cyclically press against the spring whereby causes the agitating plate to slide back and forth.

In some powder housing units, a cam member that causes the agitating plate to slide back and forth is arranged inside its casing for saving costs and spaces. However, when the casing is filled with the toner, a part of the toner can be caught between sliding surfaces of a cam member and a bearing of the agitating plate. If a part of the toner is caught between the cam member and the agitating plate, the caught toner generates minute vibration during sliding of the agitating plate. If the cam member, the agitating plate, or any surrounding member vibrates in sympathetic with the vibration, an abnormal noise that annoys surroundings is generated.

SUMMARY OF THE INVENTION

It is an object of the present invention to at least partially solve the problems in the conventional technology.

According to an aspect of the present invention, there is provided a powder housing unit that includes a casing configured to accommodate a powder; an agitating unit that is arranged inside the casing and agitates the powder so that the powder evenly spreads inside the casing; a sliding mechanism that is arranged inside the casing and causes the agitating unit to slide whereby the agitating unit agitates the powder; and a suppressing member that suppresses noise and vibration produced when the sliding mechanism slides the agitating unit.

According to another aspect of the present invention, there is provided an image forming apparatus that includes a powder housing unit and a powder collecting unit. The powder housing unit includes a casing configured to accommodate toner; an agitating unit that is arranged inside the casing and agitates the toner so that the toner evenly spreads inside the casing; a sliding mechanism that is arranged inside the casing and causes the agitating unit to slide whereby the agitating unit agitates the powder; and a suppressing member that suppresses noise and vibration produced when the sliding mechanism slides the agitating unit. The powder collecting unit collects residual toner produced in image formation process and conveys the residual toner to the casing.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 13 is a schematic diagram of an example of the lower shaft bearing shown in FIG. 12;

DETAILED DESCRIPTION OF THE PREFERRED EMBODIMENTS

Exemplary embodiments of the present invention are described in detail below with reference to the accompanying drawings.

Figure 1:
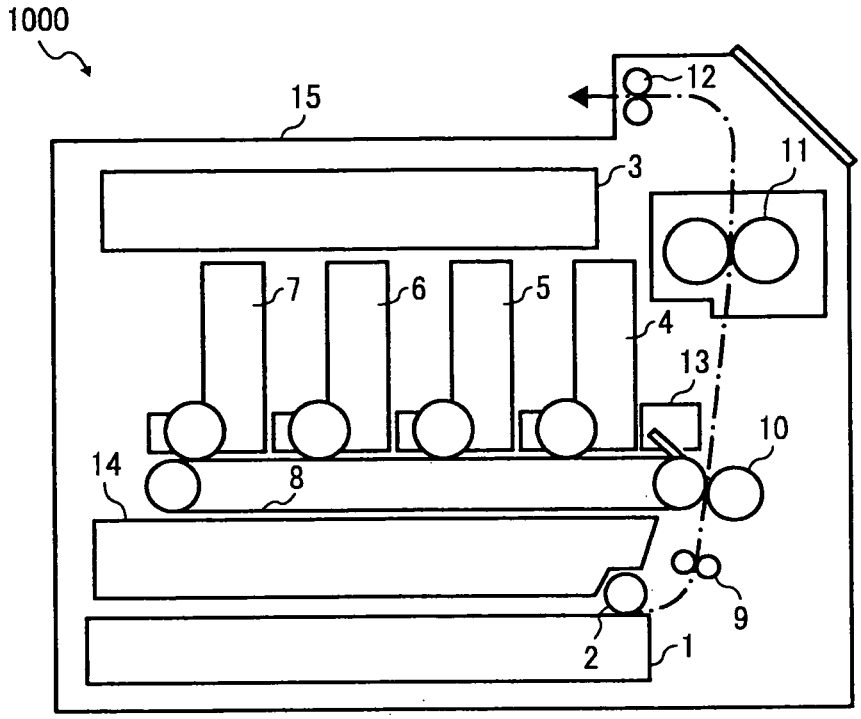
FIG. 1 is a schematic diagram of an image forming apparatus according to an embodiment of the present invention.

The configuration of an image forming apparatus 1000 according to an embodiment of the present invention will be explained below with reference to FIG. 1.

The image forming apparatus 1000 includes an exposing unit 3 that optically writes an electrostatic latent image onto each of four image forming units 4, 5, 6, and 7. A developing unit (not shown) arranged for each of the image forming units 4, 5, 6, and 7 then develops a corresponding one of the electrostatic latent image into a toner image. All the toner images from the image forming units 4, 5, 6, and 7 are then sequentially transferred onto an intermediate transfer belt 8 and also superimposed onto each other to obtain a full-color toner image.

Meanwhile, a paper feed roller 2 feeds a paper, which is stacked on a paper feed cassette 1, to a pair of registration rollers 9. The registration rollers 9 register, i.e., align, the paper. The paper is then conveyed to a secondary transfer position at a predetermined timing by the action of various rollers.

The full-color toner image that is formed on the intermediate transfer belt 8 is then transferred onto the paper at the secondary transfer position by the action of a pair of secondary transfer rollers 10.

A fixing unit then fixes the full-color toner image to the paper. The paper with the fixed image is then ejected by the action of a pair of ejecting rollers 12 into a catch tray 15.

A cleaning mechanism 13 cleans and collects residual toner on the intermediate transfer belt 8. The collected residual toner is then conveyed to a toner collection box 14 working as a powder housing unit. When the toner collection box 14 is full with residual toner, it is replaced with an empty one.

As mentioned above, from a viewpoint of user-friendliness, it is preferable to decrease a frequency of replacing the toner collection box 14. One approach for this could be to use a larger toner collection box having a higher capacity. This approach, however, will lead to increase in the overall size of the image forming apparatuses. Therefore, one of the most popular approaches is to arrange the toner collection box in a dead space in the image forming apparatuses.

In the image forming apparatus 1000, the paper feed roller 2 and the secondary transfer rollers 10 need to be arranged apart from each other due to various reasons. As a result, a dead space is produced between the paper feed roller 2 and the secondary transfer rollers 10 and the toner collection box 14 is arranged in this dead space.

Figure 2:
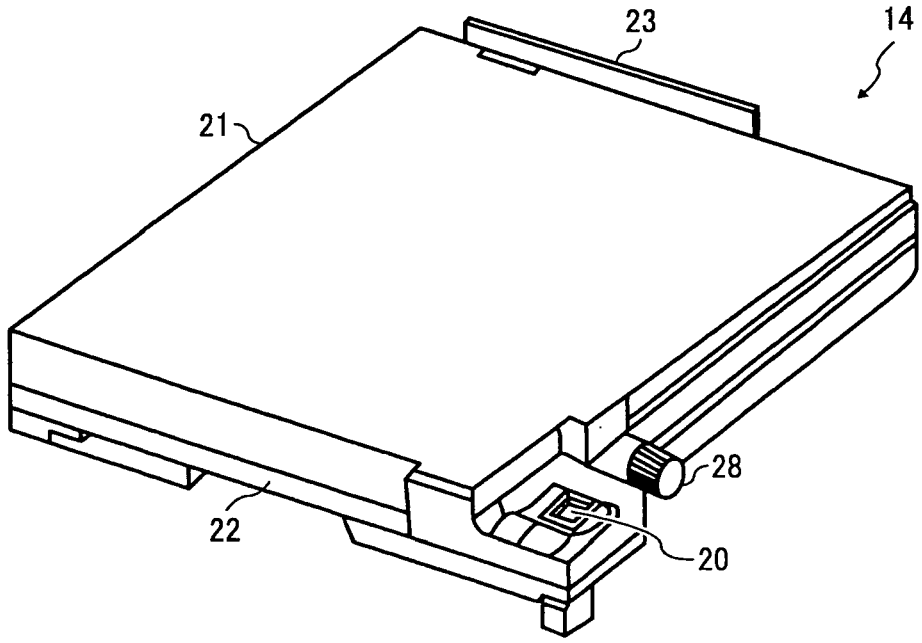
FIG. 2 is a perspective view for explaining the general configuration of a powder housing unit shown in FIG. 1.

The toner collection box 14, as shown in FIG. 2, includes an upper casing 21 with a powder inlet portion 20, a lower casing 22 that is welded to the upper casing 21, and a filling-factor sensing unit 23. A powder conveying hose (not shown) that stretches from the cleaning mechanism 13 is attached to the powder inlet portion 20. Thus, residual toner collected by the cleaning mechanism 13 is conveyed via the powder conveying hose to the toner collection box 14.

Figure 3:
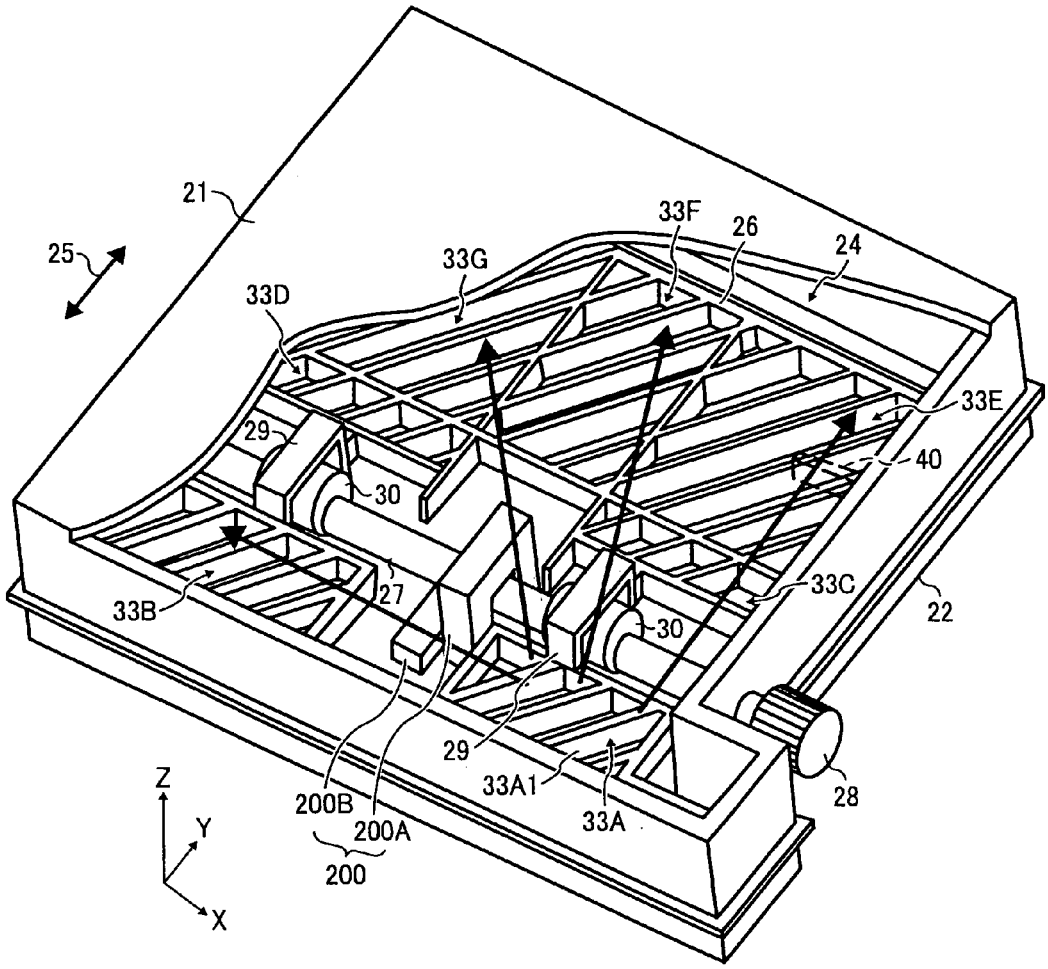
FIG. 3 is a perspective view of the powder housing unit for explaining a conveying direction corresponding to each of conveying units.

As shown in FIG. 3, a powder conveying unit 24 is housed in the lower casing 22. The powder conveying unit 24 includes an agitating plate 26 slidable back and forth in a sliding-motion direction 25 on the horizontal plane, a camshaft 27, a driving gear 28 that is fixed to an end of the camshaft 27 and is connected to a driving source (not shown) of the image forming apparatus 1000, a cam bearing 29 that is formed integrally with the agitating plate 26 and is provided at the other end of the camshaft 27, and an eccentric cam 30 that is housed in the cam bearing 29.

The camshaft 27 is supported by a shaft supporting unit 200 that is formed integrally with both the upper casing 21 and the lower casing 22.

The filling-factor sensing unit 23 senses a filling factor indicative of a ratio of the current toner amount to the allowable toner amount. A reflective photosensor is used as the filling-factor sensing unit 23 and it is arranged in the most-downstream of the toner conveying direction.

The agitating plate 26 is made of synthetic resin and it is formed as one piece. The agitating plate 26 has a plurality of conveying portions 33A, 33B, 33C, . . . , and 33G (collectively "conveying portions 33"). Each of the conveying portions 33 is defined by ribs running lengthwise and breadthwise into rectangular blocks. Each of the conveying portions 33 is partitioned into several smaller spaces by damming strips (for example, a damming strip 33A1 in the conveying portion 33A). The damming strips arranged so as not to parallel to the sliding-motion direction 25 with respect to the horizontal plane are used for pushing and moving a toner.

The damming strips are arranged at a predetermined interval in parallel to each other, i.e., the damming strips make a predetermined angle with respect to the sliding-motion direction 25. Grooves are formed between the damming strips.

All the damming strips in each of the conveying portions 33 shown in FIG. 3 are arranged at the same angle with respect to the sliding-motion direction 25. Damming strips in one of the conveying portions 33 can be arranged at an angle different from the damming strips in another conveying portion 33.

The conveying portions 33 are formed such that toner conveying directions along which a toner is conveyed are controlled as represented by full-lined arrows shown in FIG. 3.

Although the intervals between any two adjoining damming strips shown in FIG. 3 are substantially equal, it is allowable to vary the intervals thereby varying an amount of toner to be conveyed by each of the conveying portions 33. Only fewer damming strips can be in the specific conveying portion 33 if the interval between the damming strips is wider, which decreases an amount toner that can be conveyed. This results in decreasing a total toner capacity of the powder conveying unit 24.

Figure 4:
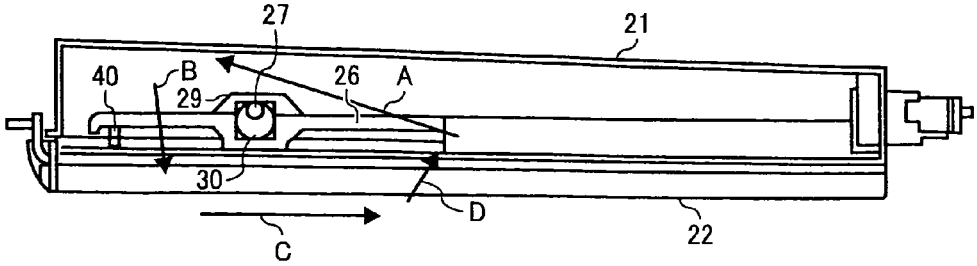
FIG. 4 is a schematic diagram for explaining a sliding motion of an agitating plate shown in FIG. 3.
Figure 5A:
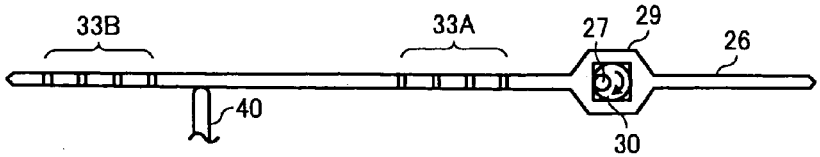
FIGS. 5A to 5D are schematic diagrams for explaining a mechanism for obtaining by the force of the sliding motion the conveying direction which goes symmetrically with respect to the plate supporting unit.
Figure 5B:
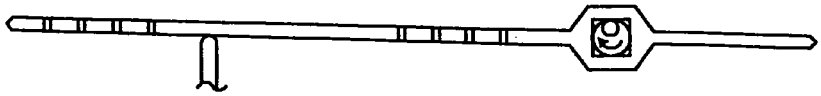
Figure 5C:
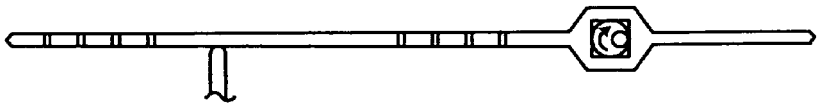
Figure 5D:
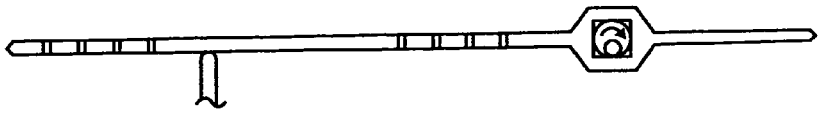
Figure 5D:
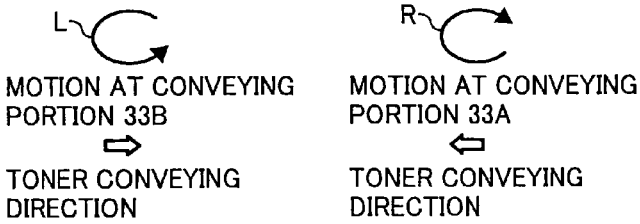

The powder conveying unit 24 slides back and forth by the driving mechanism as shown in FIG. 4. The sliding motion is separated into a forth motion and a back motion different from each other. In other words, a forth trace of the agitating plate 26 in the forth motion is different from a back trace in the back motion with respect to the gravity direction and the horizontal direction. As a result, the difference between the forth motion and the back motion in height makes it possible to break the accumulated toner and convey the toner in the conveying direction (i.e., push the toner during the forth motion).

As shown in FIG. 4, when the camshaft 27 rotates starting from a state that out of distances between any one of points on the circumference of the eccentric cam 30 and the rotation axis of the eccentric cam 30 (hereinafter, "eccentric radius") the point at the largest eccentric radius is on the bottom, the agitating plate 26 moves upward and forward in a direction indicated by an arrow A depending on a phase near the largest radius. After that, the agitating plate 26 moves downward and slightly backward in a direction indicated by an arrow B, then moves in the substantially horizontal direction indicated by an arrow C, and then moves oblique upward and slightly backward in a direction indicated by an arrow D. Repetition of those motions results in the sliding motion. During the forth motion (motion in the direction indicated by the arrow C), the agitating plate 26 moves on a bottom surface of the lower casing 22 so that the conveying portions 33 pushes and moves a toner. During the back motion (motion in the direction indicated by the arrows D and A), the agitating plate 26 floats above the bottom surface of the lower casing 22 so that the conveying portions 33 moves in a floated state, i.e., the conveying portions 33 moves without contacting with the toner. As a result, a toner remains on a position that is moved by the forth motion.

The sliding motion of the agitating plate 26 is obtained by a difference in an angle of the moving direction between the forth motion and the back motion, that is, a difference in height. The rotating rate of the eccentric cam 30 during the forth motion can differ from that during the back motion. If the rotating rate during the back motion during which the toner does not move is faster than that during the forth motion, the toner can be conveyed more rapidly.

The mechanism used in the powder conveying unit allows conveying the toner in the conveying direction variable depending on the conveying portions 33 simultaneously using a single driving source without a series of gears.

When the agitating plate 26 slides back and forth, the toner is conveyed in the conveying direction indicated by the full-lined arrows shown in FIG. 3. The filling-factor sensing unit 23 is arranged at the most-downstream of the conveying direction. If a toner inlet area is larger than an area where the filling-factor sensing unit 23 is provided, the toner inlet area cannot be easily clogged with the received toner.

The toner inlet area is adjacent to a toner storage area. The powder conveying unit 24 conveys the toner from the toner inlet area to the toner storage area, which makes it possible to prevent toner clogging at the toner inlet area.

As shown in FIG. 3, a plate supporting unit 40 that is arranged on the lower casing 22 near the filling-factor sensing unit 23 supports the agitating plate 26 from its bottom surface. The mechanism using the plate supporting unit 40 is explained with referring to FIG. 5. FIGS. 5A to 5D are schematic diagrams of the agitating plate 26, the plate supporting unit 40, and relevant parts. A cross section of the agitating plate 26 sectioned at the cam bearing 29 is shown.

When the agitating plate 26 slides back and forth in a state that a first end far away from the eccentric cam 30 is supported by the plate supporting unit 40, a toner conveying direction goes reverse in two sections divided by the plate supporting unit 40.

More particularly, in the conveying portion 33A close to the eccentric cam 30, the agitating plate 26 moves from downward to upward in a direction of an arrow R thereby the toner conveying direction going away from the eccentric cam 30.

In contrast, in the conveying portion 33B, the agitating plate 26 moves from upward to downward in a direction indicated by an arrow L thereby the toner conveying direction going close to the eccentric cam 30.

By using the mechanism, the plate supporting unit 40 is arranged so as to generate the toner conveying direction that goes away from the powder inlet portion 20 in the toner inlet area and goes close to the powder inlet portion 20 in an area far away from the powder inlet portion 20.

Given below is an explanation of the structure of suppressing vibration thereby preventing noise and abnormal noise used in the supporting unit of the camshaft 27 or the agitating plate 26.

Figure 6A:
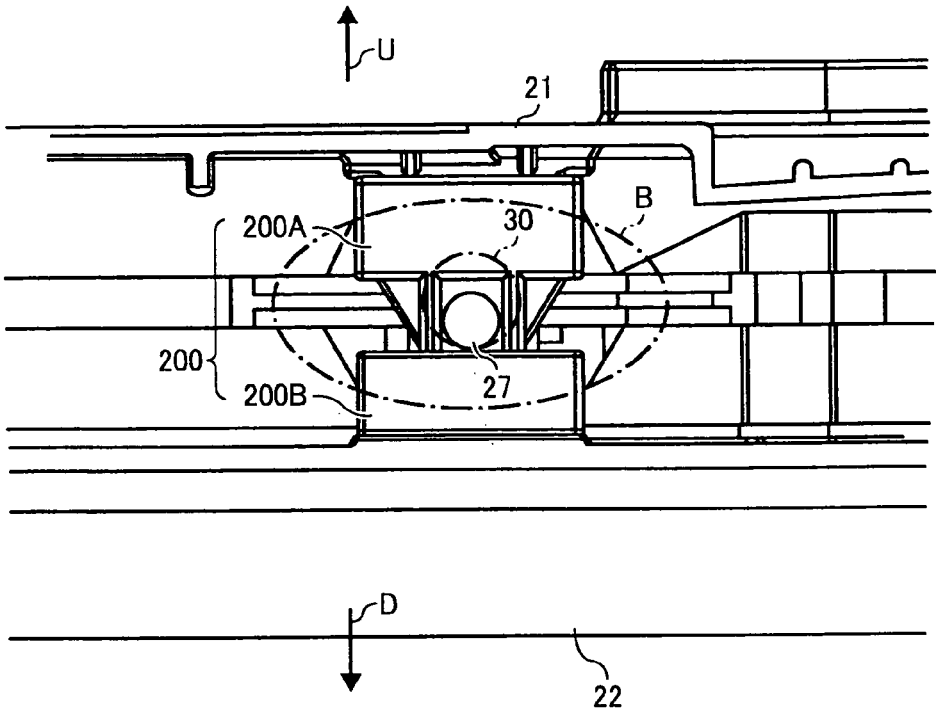
FIG. 6A is a schematic diagram of a camshaft and a shaft supporting unit for explaining the camshaft supporting structure.
Figure 6B:
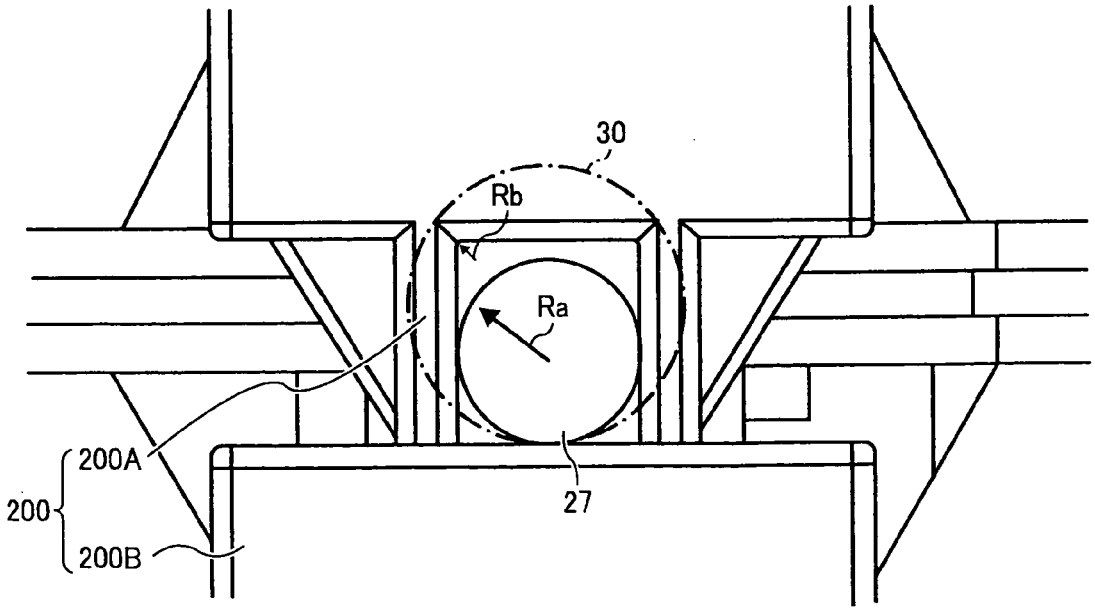
FIG. 6B is an enlarged view of area B shown in FIG. 6A.

FIG. 6 is a schematic diagram of the shaft supporting unit 200. The shaft supporting unit 200 includes an upper shaft bearing 200A that is attached to the upper casing 21 and a lower shaft bearing 200B that is attached to the lower casing 22.

The upper shaft bearing 200A is made of resin and engaged with an engaged portion (not shown), for example, a rib formed on the upper casing 21 in a detachable manner, surrounding the circumference excluding the lower circumference of the camshaft 27. More particularly, the upper shaft bearing 200A is made of a resin different from a material making the upper casing 21, and engaged with, for example, a rib that is formed on the upper casing 21 in a detachable manner. The upper shaft bearing 200A is engaged with the upper casing 21 by means of push operation. To detach the upper shaft bearing 200A, the upper casing 21 is first removed from the lower casing 22 by pulling in a direction indicated by an arrow U, and the upper shaft bearing 200A is then pulled out from the upper casing 21 in a direction indicated by the arrow D.

Figure 7:
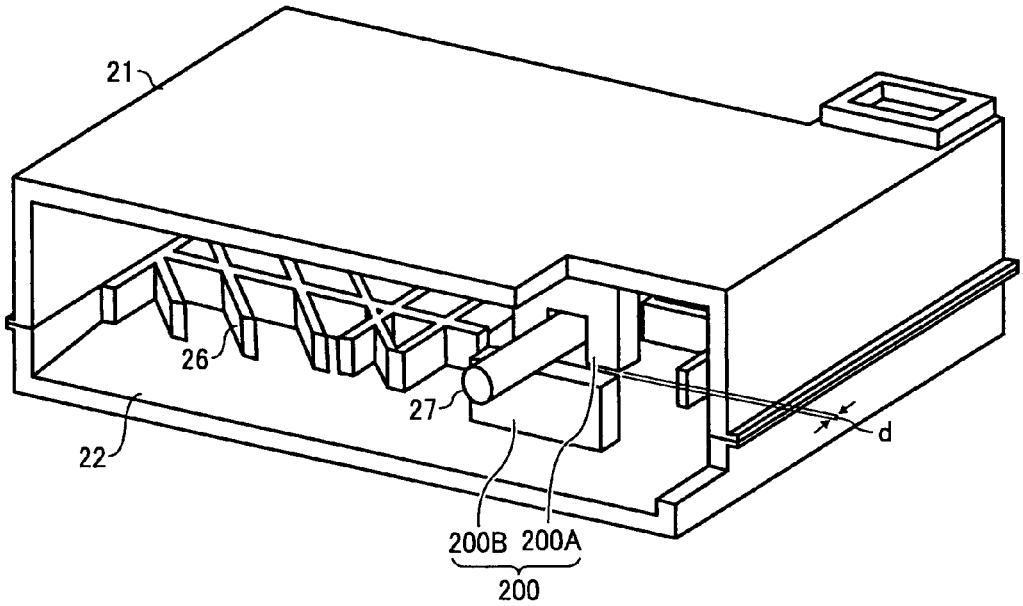
FIG. 7 is a perspective view for explaining layout of the shaft supporting unit shown in FIG. 3.
Figure 8:
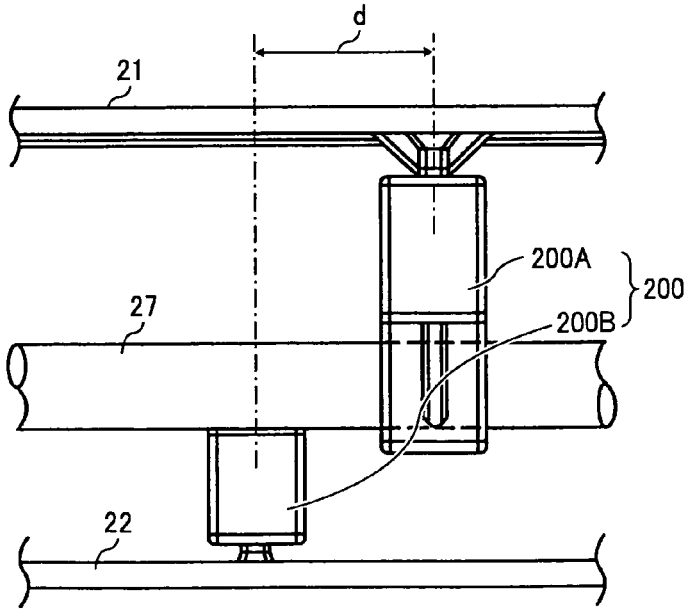
FIG. 8 is an enlarged schematic diagram for explaining the layout shown in FIG. 7.

The lower shaft bearing 200B is a member on which the camshaft 27 is mounted thereby positioning the camshaft 27. As shown in FIGS. 7 and 8, the lower shaft bearing 200B is attached to the lower casing 22 at a position displaced from the upper shaft bearing 200A with respect to the axis direction of the camshaft 27. Gap d indicates a gap between the upper shaft bearing 200A and the lower shaft bearing 200B with respect to the axis direction.

The lower shaft bearing 200B is made of a resin different from a material making the lower casing 22, and engaged with an engaged portion (not shown), for example, a rib formed on the lower casing 22 in a detachable manner.

To remove the lower shaft bearing 200B from the lower casing 22, the lower casing 22 is first removed from the upper casing 21 by pulling in the direction indicated by the arrow D, and the lower shaft bearing 200B is then pulled out from the lower casing 22 in the direction indicated by the arrow U. Thus, the simple push operation allows improving efficiency of assembly.

The upper shaft bearing 200A and the lower shaft bearing 200B are separately formed from the upper casing 21 and the lower casing 22. This makes it possible to form bearing surfaces of the upper shaft bearing 200A and the lower shaft bearing 200B that come in contact with the camshaft 27 with a lower coefficient-of-friction (COE) material than those materials making the upper casing 21 and lower casing 22.

The upper shaft bearing 200A is shaped like a rectangular removing a lower side thereof such that it can surround the circumference of the camshaft 27 excluding the lower circumference. Moreover, the upper shaft bearing 200A is shaped to form a space (hereinafter, "toner discharge path") between the camshaft 27 and the upper shaft bearing 200A.

The upper shaft bearing 200A has a contact-less surface not contacting with the camshaft 27. If a radius of curvature (ROC) of a corner of the contact-less surface is Rb and a ROC of the camshaft 27 is Ra, then Rb is smaller than Ra. The upper shaft bearing 200A is such formed that Rb becomes smaller than Ra, i.e., it forms a space near the corners of the non-contact surface as the toner discharge path.

As a result, a toner caught between the bearing surface and the camshaft 27 can be discharged from the upper shaft bearing 200A via the toner discharge path. This makes it possible to suppress vibration produced by the toner remaining on the bearing surface thereby preventing noise and abnormal noise.

As shown in FIGS. 6 and 7, the upper shaft bearing 200A is shaped like a rectangular removing a lower side thereof such that it can surround the circumference of the camshaft 27 excluding the lower circumference. The lower shaft bearing 200B has a plane on which the lower circumference of the camshaft 27 is mounted.

Figure 9:
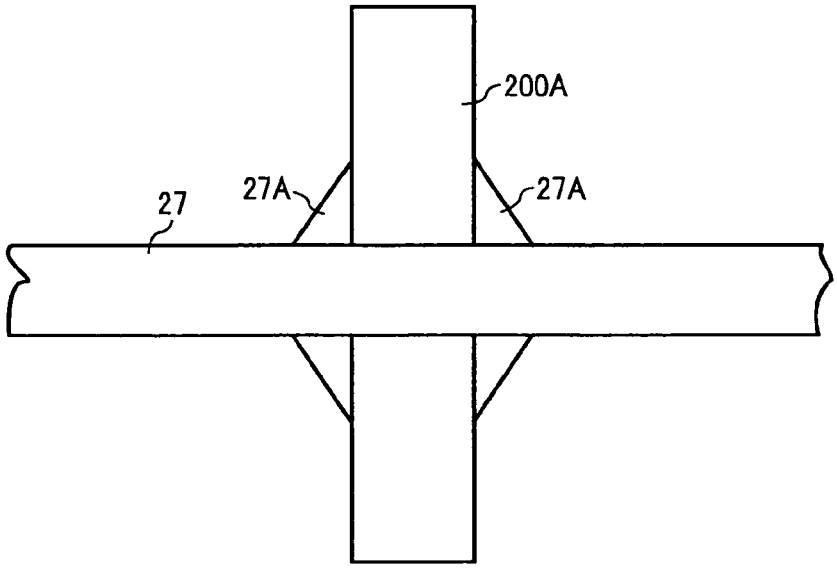
FIG. 9 is a schematic diagram for explaining axis-direction positioning of the camshaft using an upper shaft bearing.

The upper shaft bearing 200A supports the camshaft 27 in a rotatable manner and fixes the camshaft 27 at a predetermined position with respect to the axis direction and the gravity direction. More particularly, for example, a pair of hubs 27A is formed on the camshaft 27 for fixing a position with respect to the axis direction as shown in FIG. 9. The hubs 27A comes abut against opposite faces in the axis direction of the upper shaft bearing 200A thereby stopping movement in the axis direction. The moving of the camshaft 27 in the upward gravity direction is stopped by using the bearing surfaces that comes in contact with the outer circumference. The hubs 27A come abut against the upper shaft bearing 200A, for example, by first attaching one of the hubs 27A to the upper shaft bearing 200A, inserting the camshaft 27 through the upper shaft bearing 200A, and then attaching the other hub 27A to the upper shaft bearing 200A. The hubs 27A are fixed to the camshaft 27, for example, using a screw formed on the outer circumference of the camshaft 27.

The moving of the camshaft 27 in the downward gravity direction is stopped by the plane of the lower shaft bearing 200B on which the camshaft 27 is mounted as shown in FIGS. 7 and 8.

The simple plane-shaped bearing surface of the lower shaft bearing 200B does not require a high-precise process thereby allowing reducing in processing costs.

Given below is an explanation of another embodiment of the present invention.

The embodiment has the structure of suppressing noise and abnormal noise caused from a vibration of the camshaft 27.

Figure 10:
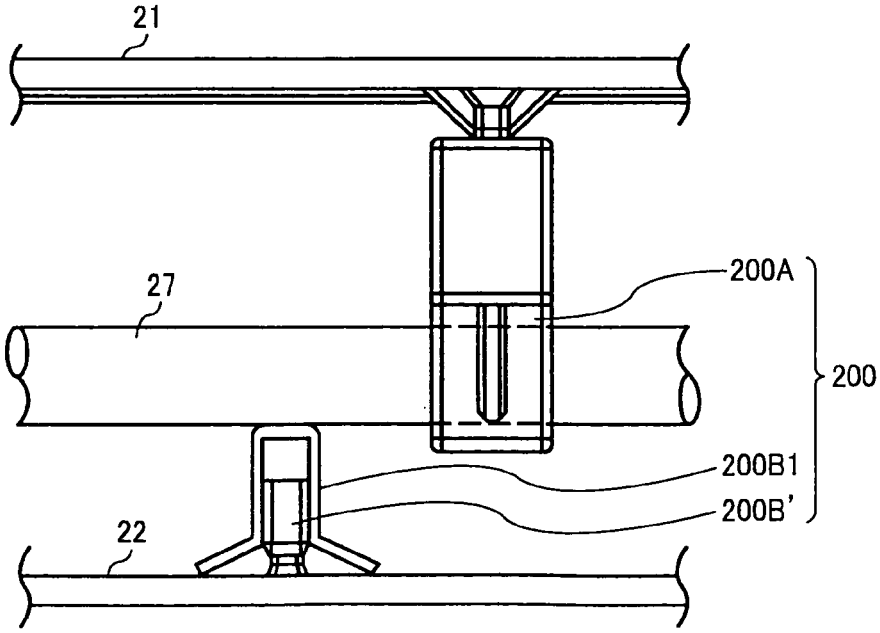
FIG. 10 is a schematic diagram for explaining the structure of a lower shaft bearing shown in FIG. 7.

The shaft supporting unit 200 shown in FIG. 10 includes the upper shaft bearing 200A, a lower shaft bearing 200B', and a bearing member 200B1. The bearing member 200B1 is mounted over the lower shaft bearing 200B'. The lower circumference of the camshaft 27 comes in contact with not the lower shaft bearing 200B' but the bearing member 200B1. The bearing member 200B1 has a lower COE than the lower shaft bearing 200B'.

The bearing member 200B1 is made from a metallic plate, and therefore the bearing member 200B1 can be formed to have an inertial mass larger than that of the resin-made lower shaft bearing 200B. The metallic plate is used to form the bearing member 200B1 that hardly vibrates in sympathetic to vibration of the camshaft 27.

With such a configuration, when the vibration of the camshaft 27 is propagated, the bearing member 200B1 having a larger inertial mass hardly vibrates in sympathetic to the vibration of the camshaft 27 because the resonance frequency of the bearing member 200B1 is different from that of the camshaft 27. As a result, the noise and abnormal noise caused from the vibration is suppressed.

Given below are explanations of modifications of the structure of increasing the inertial mass with referring to FIGS. 11 to 13.

Figure 11:
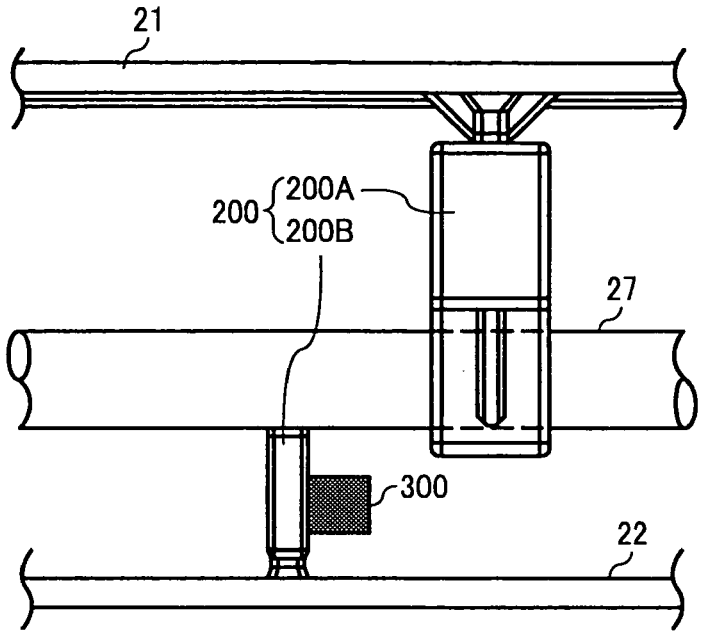
FIG. 11 is a schematic diagram of a modification of the lower shaft bearing shown in FIG. 10.

In the structure shown in FIG. 11, the lower shaft bearing 200B is integrally formed with a weight 300. The weight 300 is attached to a surface of the lower shaft bearing 200B not contacting with the camshaft 27. In the structure shown in FIG. 12, sticky magnets 300A and 300B working as the weight 300 are attached to the opposite faces in the axis direction of the lower shaft bearing 200B. In the structure shown in FIG. 13, a weight 300C working as the weight 300 is fixed to the lower shaft bearing 200B nipping the lower shaft bearing 200B from its opposite surfaces using a screw mechanism.

Figure 12:
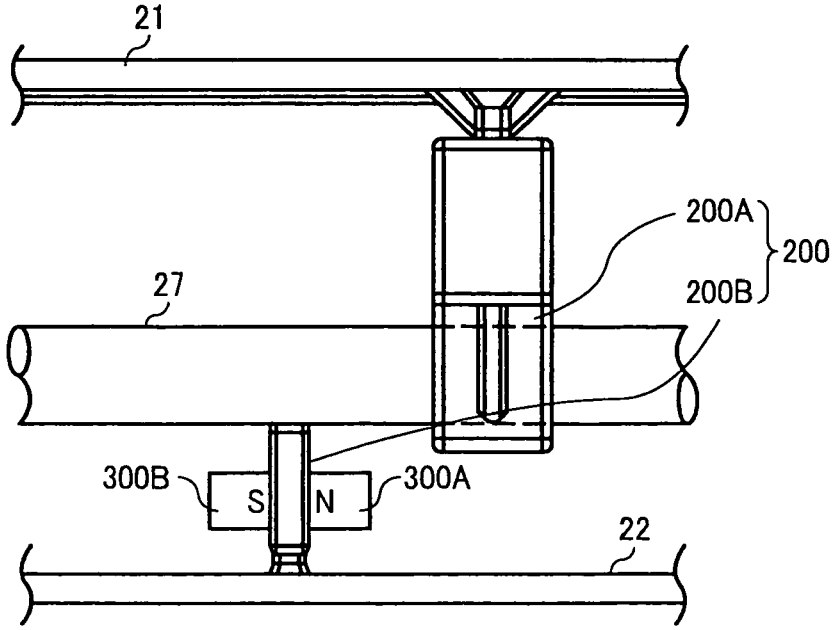
FIG. 12 is a schematic diagram of a modification of the lower shaft bearing shown in FIG. 11.
Figure 13:
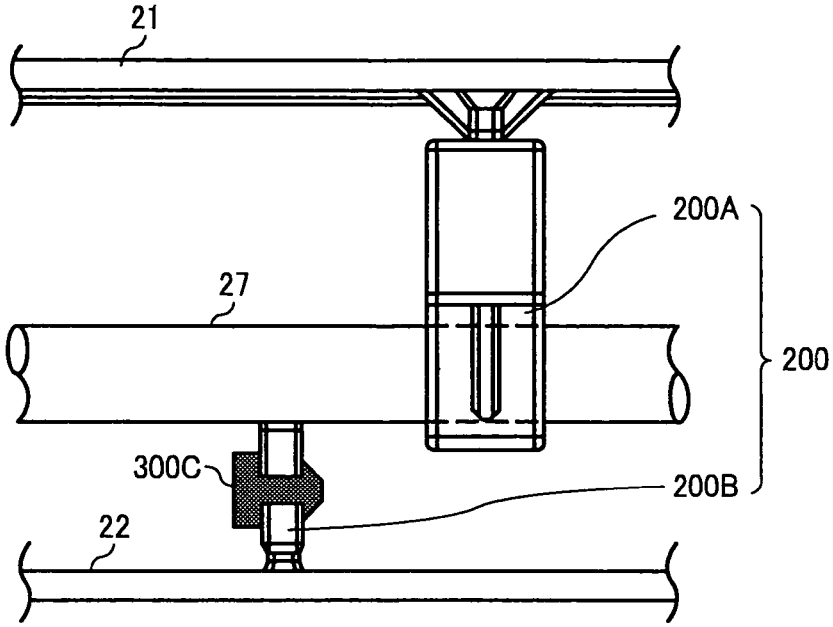
FIG. 13 is a schematic diagram of a modification of the lower shaft bearing shown in FIG. 12.

In any structure shown in FIGS. 11 to 13, because the lower shaft bearing 200B has a larger inertial mass, it is possible to suppress resonance. The structure shown in FIG. 12 can be implemented without the integrated structure as shown in FIG. 11. The structure shown in FIG. 13 can obtain an effect of tightly fixing the weight to the lower shaft bearing 200B.

Given below is an explanation of another embodiment of the present invention.

The embodiment has an anti-vibration mechanism for the plate supporting unit 40 that slides and contacts on the bottom surface of the agitating plate 26 in addition to the anti-vibration mechanism for the camshaft 27.

Figure 14:
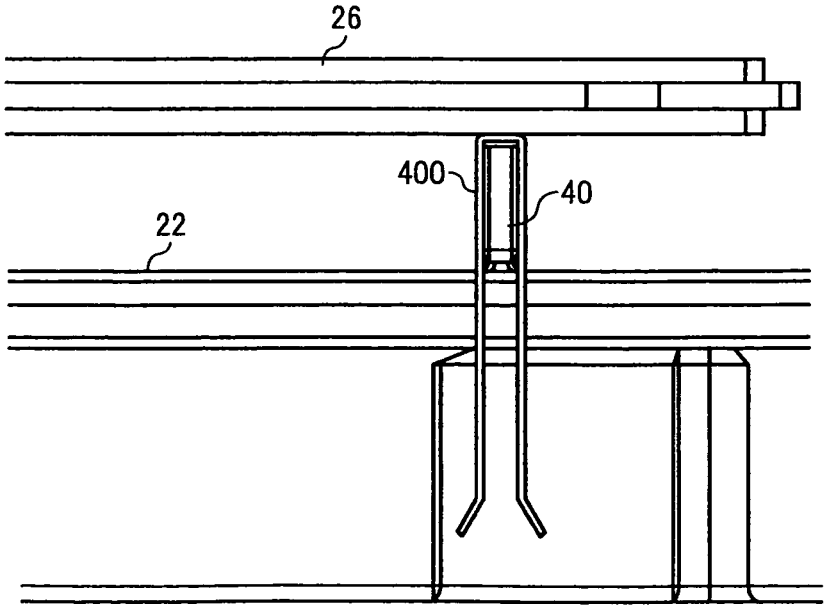
FIG. 14 is a schematic diagram of relevant parts for the structure of supporting the agitating plate shown in FIG. 3.

As shown in FIG. 14, the agitating plate 26 that is a plate horizontally arranged inside the powder housing unit conveys a toner by the sliding motion. The sliding motion is affected by the plate supporting unit 40 that is provided on an inner surface of the lower casing 22 supports the agitating plate 26 from its bottom surface. The plate supporting unit 40 is formed separately from the lower casing 22 and is attached to the lower casing 22 in a detachable manner. A sliding surface of the plate supporting unit 40 is covered by a plate supporting member 400.

The plate supporting unit 400 is formed from a metallic plate having a larger inertial mass than the plate supporting unit 40 has. The plate supporting unit 400 is attached to the lower casing 22 together with the plate supporting unit 40.

With the above structure, the plate supporting unit 40 and the plate supporting member 400 are formed integrally so that the integrated member having the larger inertial mass is used for supporting the agitating plate 26. This makes it possible to suppress vibration produced by the agitating plate 26 during the sliding.

Moreover, a material making the plate supporting member 400 is different from a material making the plate supporting unit 40. This allows forming the plate supporting member 400 with an expensive low COE material thereby obtaining a higher anti-vibration effect while suppressing increase in processing costs.

Given below are explanations of modifications of the anti-vibration structure used in the plate supporting unit 40 with referring to FIGS. 15 to 17.

Figure 15:
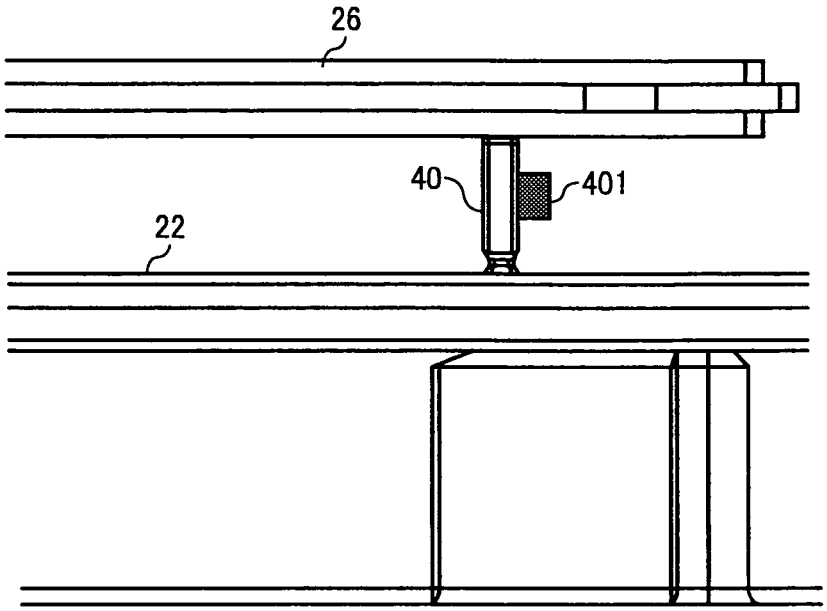
FIG. 15 is a schematic diagram of a modification of the relevant parts shown in FIG. 14.

In the structure shown in FIG. 15, the plate supporting unit 40 is integrally formed with a weight 401. The weight 401 is attached to a surface of the plate supporting unit 40 so as not to contact with the agitating plate 26. In the structure shown in FIG. 16, magnets 401A and 401B are attached to opposite surfaces in the sliding direction of the agitating plate 26. In the structure shown in FIG. 17, a weight 401C is fixed to the plate supporting unit 40, nipping the plate supporting unit 40 from its opposite surfaces with respect to the sliding direction using a screw mechanism.

Figure 16:
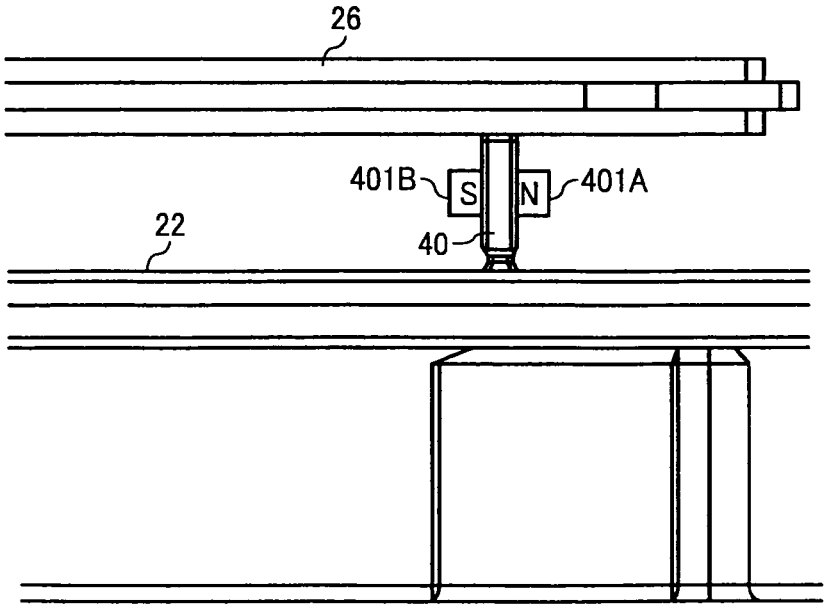
FIG. 16 is a schematic diagram of a modification of the relevant parts shown in FIG. 15.
Figure 17:
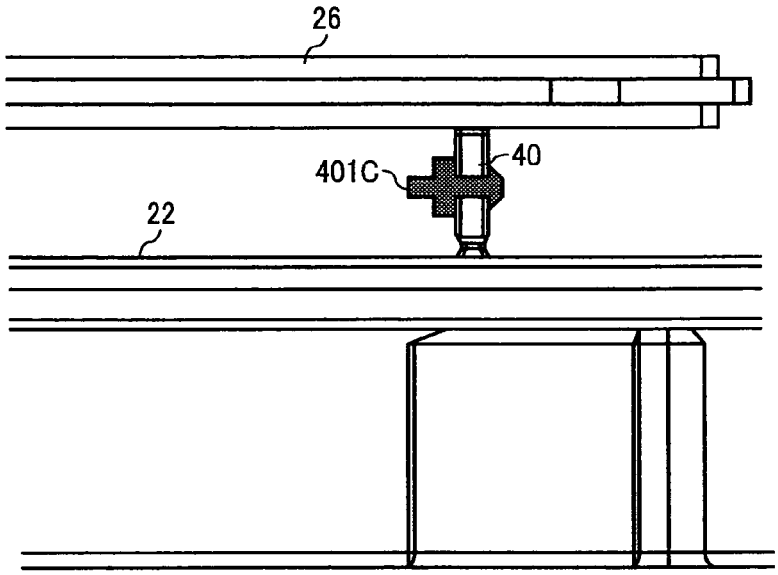
FIG. 17 is a schematic diagram of an example of the relevant parts shown in FIG. 16.

In any structure shown in FIGS. 15 to 17, because the plate supporting unit 40 has a larger inertial mass, it is possible to suppress resonance. The structure shown in FIG. 16 can be implemented without the integrated structure as shown in FIG. 15. The structure shown in FIG. 17 can obtain an effect of tightly fixing the weight to the plate supporting unit 40.

The image forming apparatus 1000 and the toner collection box 14 according to a second embodiment of the present invention are described below.

As shown in FIG. 2, the toner collection box 14 is arranged between the transfer device and the paper feed cassette 1. The toner collection box 14 is attached to a main body of the image forming apparatus 1000 in a detachable manner.

As shown in FIG. 2, in the toner collection box 14, dimensions in X direction and Y direction on the horizontal plane are larger than a dimension in Z direction, i.e., the gravity direction. In other words, the toner collection box 14 is flatly shaped. The powder conveying hose that extends from the cleaning mechanism 13 is connected to the powder inlet portion 20.

The cam bearing 29 shown in FIG. 5A to 5D is a cross section orthogonal to the camshaft 27. As seen from FIG. 5A to 5D, the cam bearing 29 that supports the agitating plate 26 is shaped like a square pillar. The cam bearing 29 accommodates the eccentric cam 30 by passing the camshaft 27 therethrough.

Figure 18:
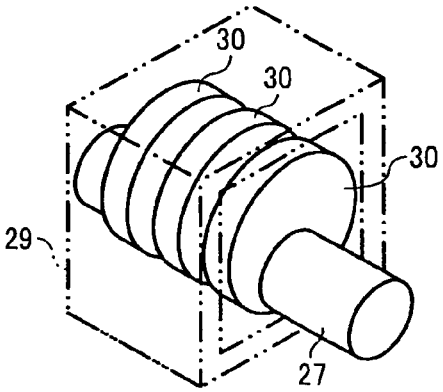
FIG. 18 is a perspective view of the cam member shown in FIG. 3.

As shown in FIG. 18, the camshaft 27 is provided with three disk-shaped cams that are arranged at different positions in the axis direction as the eccentric cam 30. The three eccentric cams 30 have an identical eccentric phase with respect to the camshaft 27.

If a thick cam is used as the eccentric cam 30, a contact area between sliding surfaces of the cam bearing 29 and the eccentric cam 30 becomes large so that a pressure between the sliding surfaces decreases. However, when the thick eccentric cam 30 and the camshaft 27 are integrally molded by the resin injection molding, a silk mark can be formed because the resin hardens unequally. The eccentric cam 30 having the silk mark can inhibit a smooth sliding movement and produce noise during the sliding. To avoid the problem, the eccentric cam 30 that is provided with the camshaft 27 is formed with a plurality of (for example, three) eccentric cams each having a thickness small enough to prevent a silk mark, thereby causing the pressure between the sliding surfaces during the sliding to decrease.

Figure 19:
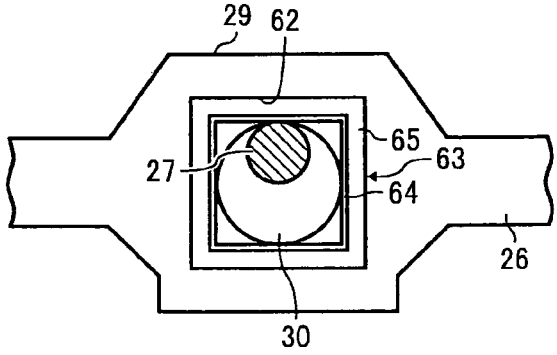
FIG. 19 is a side view of the cam bearing shown in FIG. 3.

As shown in FIG. 19, the cam bearing 29 that is shaped like a square pillar is provided with an anti-vibration member 63 over an inner surface 62 having four faces (plane portions). The anti-vibration member 63 includes a slid layer 64 that is the innermost layer coming in contact with the eccentric cam 30 and an anti-vibration layer 65 that supports the slide layer 64. A double-stick tape or adhesive agent is used for adhering between the slide layer 64 and the anti-vibration layer 65 and between the anti-vibration layer 65 and the inner surface 62.

Because the slide layer 64 is required to have a high slidability and a high durability, the slide layer 64 is made of a film material such as polytetrafluoroethylene (PTFE), polyethylene terephthalate (PET), or nylon-based material. A metallic material, for example, copper or aluminum having a high slidability or stainless having a high slidability and an anti-corruption can be used as the material of the slide layer 64. Any material having a high slidability and a high durability can be used.

Figure 20:
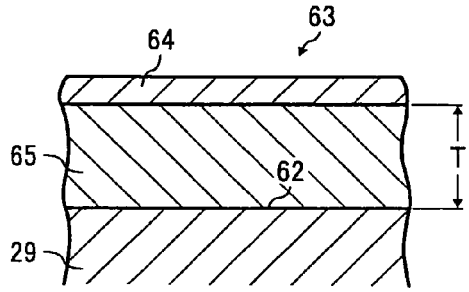
FIG. 20 is an enlarged cross-sectional view of an anti-vibration member.

The anti-vibration layer 65 is made of an elastic material such as a rubber. A formed material, for example, urethane foam having elasticity can be used as the material of the anti-vibration layer 65. As shown in FIG. 20, thickness T indicative of the thickness of the anti-vibration layer 65 is preferably within a range from 1 millimeter to 7 millimeters. If the anti-vibration layer 65 having thickness T larger than 7 millimeters is used, the elasticity of the anti-vibration layer 65 becomes too large, so that the force produced by the eccentric cam 30 cannot be surely transmitted to the agitating plate 26. If the anti-vibration layer 65 having thickness T smaller than 1 millimeter is used, the elasticity of the anti-vibration layer 65 becomes too small to ensure a desired anti-vibration effect.

The toner caught between the sliding surfaces of the eccentric cam 30 and the cam bearing 29 causes a minute vibration thereby causing abnormal noise. Out of such vibrations, a minute vibration produced by two sliding surfaces pressing to each other can cause a larger abnormal noise. If the anti-vibration member 63 is provided to a portion that presses against the cam bearing 29, it is possible to effectively suppress abnormal noises.

Figure 21:
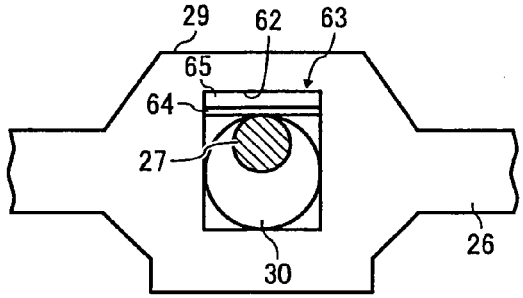
FIG. 21 is a side view of a cam bearing according to another embodiment of the present invention.

More particularly, in an embodiment of the present invention as shown in FIG. 21, the anti-vibration member 63 is provided over at least an upper face out of the four faces of the inner surface 62. This is because the upper face that supports the agitating plate 26 presses against the eccentric cam 30 by a weight of the agitating plate 26.

Figure 22:
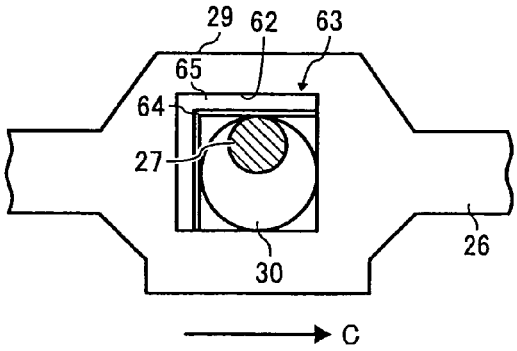
FIG. 22 is a side view of a cam bearing according to still another embodiment of the present invention.

In another embodiment of the present invention as shown in FIG. 22, the anti-vibration member 63 is provided over at least the upper face and a left face out of the four faces of the inner surface 62. This is because the left face presses against the eccentric cam 30 when the agitating plate 26 moves the toner in the direction indicated by the arrow C.

Figure 23:
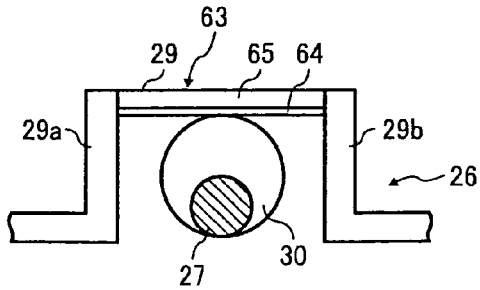
FIG. 23 is a side view of a cam bearing according to still another embodiment of the present invention.

A part of the cam bearing 29 can be made with the anti-vibration member 63. More particularly, as shown in FIG. 23, an upper portion of the cam bearing 29 is formed with the anti-vibration member 63, and resin frames 29*a* and 29*b* of the cam bearing 29 are adhered to side portions of the anti-vibration member 63.

Given below are explanations of modifications of the cam member (eccentric cam 30).

Figure 24:
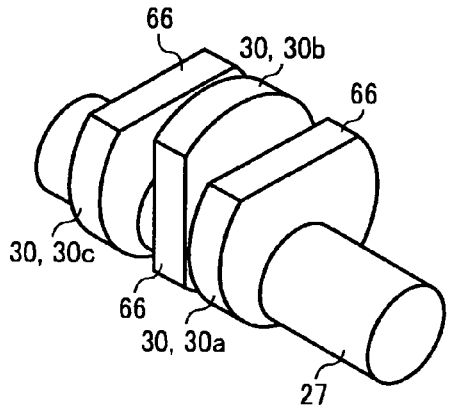
FIG. 24 is a perspective view of a cam member according to still another embodiment of the present invention.

The eccentric cam 30 shown in FIG. 24 is produced by cutting a certain portion (hereinafter, "cut portion 66") of each of the three eccentric cams 30 (30*a*, 30*b*, and 30*c*) shown in FIG. 18. The cut portions of the side eccentric cams 30 (i.e., the eccentric cams 30*a* and 30*c*) are formed at the identical phase angle. The cut portion 66 of the center eccentric cam (i.e., the eccentric cam 30*b*) is formed at a phase angle shifted 90° from the phase angle of the cut portions 66 of the eccentric cams 30*a* and 30*c*.

Figure 25:
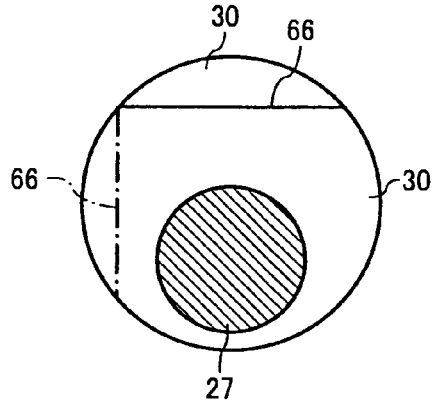
FIG. 25 is a side view of the cam member shown in FIG. 24.

FIG. 25 is a side view of the eccentric cam 30 shown in FIG. 24. A cross section of the eccentric cam 30 orthogonal to the camshaft 27 is shown. The cut portions 66 of the eccentric cams 30*a*, 30*b*, and 30*c* are arranged in an imperfectly overlapped manner such that the eccentric cams 30 looks circle.

Although cut surfaces of the cut portions 66 of the eccentric cams 30 shown in FIGS. 24 and 25 are shaped plane, the cut surfaces can be shaped curbed or a plane with a step. It is allowable to arrange each of the eccentric cams 30 to have a different phase angle by shifting at any degrees including 90°.

Figure 26:
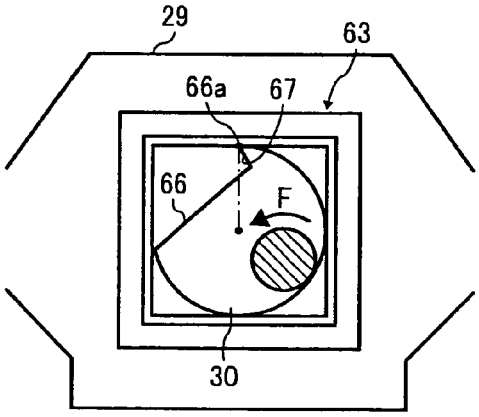
FIG. 26 is a side view of a modification of the cam member shown in FIG. 24.

It is allowable to form a scoop surface 67 as shown in FIG. 26 at a back end 66*a* of the cut portion 66 assuming that the rotating direction of the camshaft 27 indicated by an arrow F is heading forward. The scoop surface 67 is a plane stretching inward from the back end 66*a* sloping backward or a plane stretching toward the center point of the camshaft 27. When the eccentric cam 30 rotates, the toner attaching on the anti-vibration member 63 is removed by the scoop surface 67.

Figure 27:
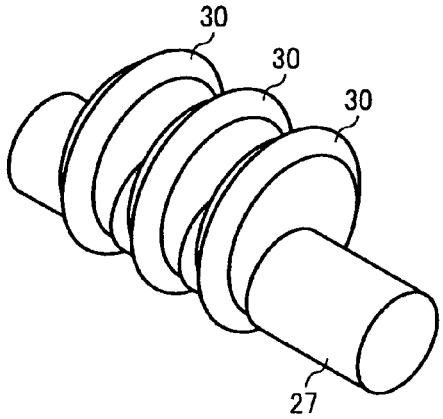
FIG. 27 is a perspective view of a cam member according to another embodiment of the present invention.

The eccentric cam 30 shown in FIG. 27 has a double-edged outer circumference. The outer circumference of the eccentric cam 30 can be a single edged.

Figure 28:
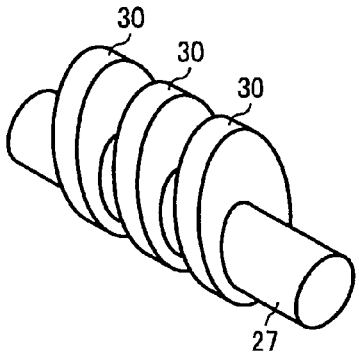
FIG. 28 is a perspective view of a cam member according to still another embodiment of the present invention.

The eccentric cam 30 shown in FIG. 28 is obtained by arranging the three eccentric cams 30 shown in FIG. 18 such that each of the eccentric cams 30 makes an identical angle with a corresponding plane orthogonal to the rotation axis of the camshaft 27. The angle formed by each of the eccentric cams 30 and the corresponding plane orthogonal to the rotation axis can vary.

The three sloping eccentric cams 30 described above can be joined with each other in a spiral form. If the eccentric cam 30 is in the spiral form, the eccentric cam 30 can function as a screw conveyor for conveying a toner. It is allowable to extend the eccentric cam 30 in the spiral form in the axis direction of the camshaft 27. Blades of the eccentric cam 30 in the spiral form can be arranged at variable intervals. Non-eccentric blades can be used as the blades of the eccentric cam 30. Such structure has an effect of increasing an amount of toner to be conveyed in the axis direction of the camshaft 27.

It is possible to use the eccentric cam 30 having structure combining any two or three of the structure having the cut portion 66 shown in FIG. 24, the structure having an edged outer circumference shown in FIG. 27, and the structure having the sloped arrangement shown in FIG. 28.

Figure 29:
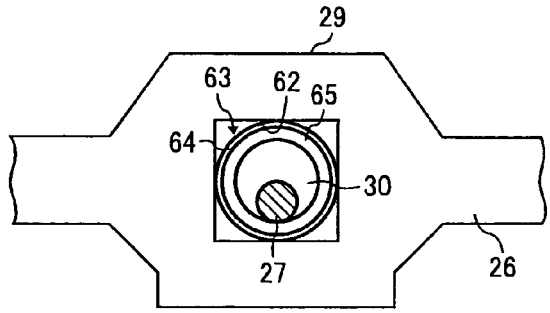
FIG. 29 is a side view of a cam member on which the anti-vibration member is formed according to still another embodiment of the present invention.

In an embodiment of the present invention shown in FIG. 29, the anti-vibration member 63 that includes the slide layer 64 and the anti-vibration layer 65 is provided on the outer circumference of the eccentric cam 30. The anti-vibration member 63 is not provided on the cam bearing 29, and the inner surface 62 of the cam bearing 29 and the slide layer 64 function as slide surfaces. An entire of the eccentric cam 30 can be formed with the anti-vibration member 63 if the force produced by the eccentric cam 30 is surely transmitted to the agitating plate 26. Moreover the anti-vibration member 63 can be formed on both the inner surface 62 of the cam bearing 29 and the outer circumference of the eccentric cam 30.

Figure 30:
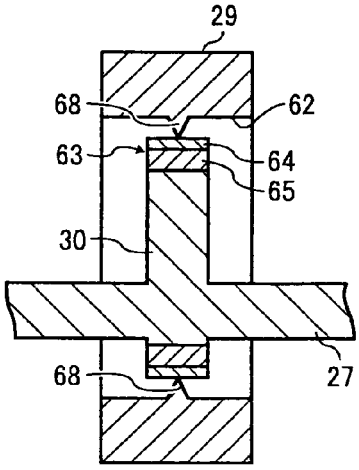
FIG. 30 is a top view of the cam bearing shown in FIG. 29.
Figure 31A:
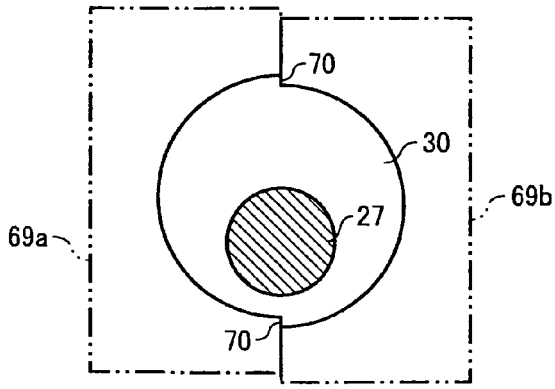
FIG. 31A is a schematic diagram for explaining an exemplary method of molding the cam bearing shown in FIG. 29.
Figure 31B:
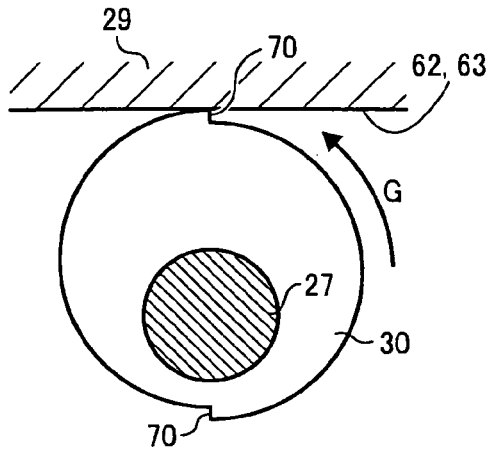
FIG. 31B is a schematic diagram for explaining a rotating direction of the cam member.
Figure 32A:
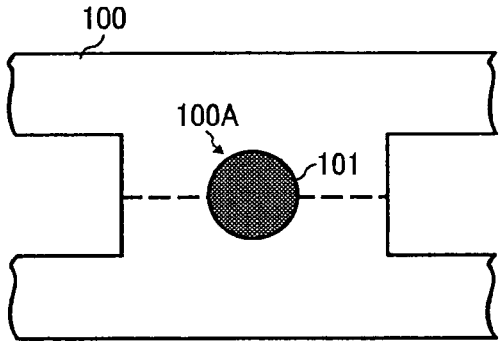
FIGS. 32A and 32B are schematic diagrams for explaining the structure of a conventional shaft supporting unit.
Figure 32B:
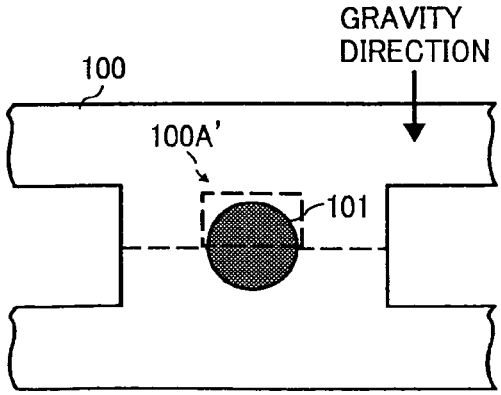

FIG. 30 is a top view of the cam bearing 29 and the eccentric cam 30 horizontally sectioned. The anti-vibration member 63 is provided on the outer circumference of the eccentric cam 30. The inner surface 62 of the cam bearing 29 has a pointed protrusion 68. The head of the pointed protrusion 68 slides on the slide layer 64 of the anti-vibration member 63.

In the image forming apparatus 1000, the residual toner remains on the intermediate transfer belt 8 after transfer of the toner image from the intermediate transfer belt 8 to a paper. The residual toner is removed from the intermediate transfer belt 8 by the cleaning mechanism 13.

As shown in FIG. 2, the toner removed from the intermediate transfer belt 8 is conveyed to the powder inlet portion 20 of the toner collection box 14 by a wasted-toner conveying unit (not shown), and is collected in the toner collection box 14.

If the eccentric cam 30 according to an embodiment shown in FIGS. 18 and 19 is used, a possibility of presence of a toner caught between the outer circumference of the eccentric cam 30 and the anti-vibration member 63 of the cam bearing 29 increases as the toner amount within the toner collection box 14 increase. Because the entire outer circumference of the eccentric cam 30 continuously slides on the anti-vibration member 63, the toner once caught between the sliding surfaces of the eccentric cam 30 and the anti-vibration member 63 hardly goes out and remains between the sliding surfaces. This mechanism increases the COE between the sliding surfaces. Moreover, if a deteriorated toner is caught between the outer circumference of the eccentric cam 30 and the surface of the anti-vibration member 63, the COE increases remarkably.

The increased COE between the sliding surfaces of the eccentric cam 30 and the anti-vibration member 63 causes a minute vibration between the sliding surfaces. The minute vibration is absorbed into the anti-vibration layer 65 of the anti-vibration member 63 thereby not transmitted to surrounding members, specifically, to the agitating plate 26. This makes it possible to reduce the abnormal noise caused from vibration of the agitating plate 26. The mechanism for suppressing transmission of the minute vibration between the sliding surfaces by using the anti-vibration member 63 works in the similar manner in the embodiments shown in FIGS. 21, 22, and 23, and its explanation is omitted.

If the anti-vibration member 63 is provided on the eccentric cam 30 as shown in FIG. 29, a minute vibration caused from the toner caught between the anti-vibration member 63 of the eccentric cam 30 and the cam bearing 29 can be absorbed into the anti-vibration member 63 (the anti-vibration layer 65). This makes it possible to suppress transmission of the minute vibration to surrounding members, specifically, to the eccentric cam 30.

In the embodiment of the eccentric cam 30 shown in FIG. 24, the cut portion 66 does not come in contact with the anti-vibration member 63 of the cam bearing 29. The toner caught between the sliding surfaces of the eccentric cam 30 and the anti-vibration member 63 can go out passing through a space defined by the cut portion 66. This makes it possible to reduce an amount of toner caught between the sliding surfaces of the eccentric cam 30 and the anti-vibration member 63 thereby suppressing the COE increase.

Moreover, the three eccentric cams 30 are arranged to look circle as shown in FIG. 25, which makes it possible to smoothly slide on the anti-vibration member 63.

In the embodiment of the eccentric cam 30 shown in FIG. 27, a smaller area of the outer circumference of the eccentric cam 30 comes in contact with the anti-vibration member 63 of the cam bearing 29. This allows decreasing the amount of toner caught between the eccentric cam 30 and the anti-vibration member 63 to almost none thereby suppressing the COE increase. The eccentric cam 30 shown in FIG. 30 can obtain the similar effect.

In the embodiment of the eccentric cam 30 shown in FIG. 28, a portion on the sliding surface of the anti-vibration member 63 of the cam bearing 29 that currently comes in contact with the sliding surface of the eccentric cam 30 moves back and forth in the axis direction. This makes it possible for the toner caught between the sliding surfaces of the eccentric cam 30 and the anti-vibration member 63 to go out from the sliding surfaces. As a result, the amount of toner caught between the sliding surfaces decreases so that the COE increase is suppressed.

In the embodiments of the eccentric cam 30 shown in FIGS. 24, 27, and 28, even if the anti-vibration member 63 is not provided on either the sliding surface of the eccentric cam 30 or the sliding surface of the cam bearing 29, the COE increase is suppressed so that the abnormal noise is reduced.

If the eccentric cam 30 and the camshaft 27 are molded by the resin injection molding using dies 69*a* and 69*b*, a slight miss-alignment between the dies 69*a* and 69*b* results in a slight step 70 formed on the outer circumference of the eccentric cam 30. The eccentric cam 30 having the slight step 70 preferably rotates in a direction indicated by an arrow G. In other words, if the eccentric cam 30 slides on the inner surface 62 of the cam bearing 29 under conditions that an eccentric radius (distance between a point on the outer circumference and the rotating axis of the eccentric cam 30) at a current point that comes in contact with the inner surface 62 is larger than an eccentric radius at a point that is to come in contact immediately after the current point, the eccentric cam 30 slides smoothly without producing abnormal noise. If the eccentric cam 30 rotates in reverse to the direction indicated by the arrow G, when an outer edge of the slight step 70 comes in contact with the inner surface 62 of the cam bearing 29, an abnormal noise can be generated or a vibration is generated thereby causing the surroundings to vibrate whereby generating an abnormal noise.

Even if the eccentric cam 30 rotates in reverse to the direction indicated by the arrow G, the anti-vibration member 63 that is provided on the inner surface 62 of the cam bearing 29 can reduce shock or vibration caused from the contact of the outer edge of the slight step 70. Moreover, the outer edge that is formed on the outer circumference of the eccentric cam 30 with a certain intention can work as the scoop surface 67 shown in FIG. 26. From the viewpoint of the abnormal-noise suppression, the eccentric cam 30 preferably rotates in the direction indicated by the arrow G even if the anti-vibration member 63 for reducing the shock or the vibration produced by the eccentric cam 30 is provided.

If the cut portion 66 shown in FIG. 24 is formed by cutting a portion on which the slight step 70 is formed, the number of the slight steps that come in contact with the cam bearing 29 is reduced. Thus, it is possible to suppress an abnormal noise generated when the outer edge of the slight step comes in contact with the cam bearing 29.

As shown in FIG. 24, it is preferable to arrange the side eccentric cams 30*a* and 30*c* such that the cut portions 66 are located at an identical phase angle. This allows the side eccentric cams 30*a* and 30*c* to slide on the anti-vibration member 63 of the cam bearing 29 in a synchronous manner. If the side eccentric cams 30*a* and 30*c* slide in an asynchronous manner, the anti-vibration member 63 receives a force asymmetric to the axis direction of the camshaft 27 during the sliding. The asymmetric force increases a possibility of the anti-vibration member 63 to be stripped off from the inner surface 62 of the cam bearing 29.

The present invention is not limited to the above embodiments, and various modifications can be made to the present invention without departing from the scope of the present invention. For example, the number of the eccentric cams 30 provided to the camshaft 27 can be one or two, or four or larger. The shape of the eccentric cam 30 and the cam bearing 29 is not limited to the shapes shown in the drawings.

The layout of units in the toner collection box 14 such as the powder inlet portion 20, the eccentric cam 30, and the cam bearing 29 is not limited to the layout shown in FIG. 3. If the eccentric cam 30 and the cam bearing 29 are located far away from the powder inlet portion 20, the possibility of capture of toner between the eccentric cam 30 and the cam bearing 29 can be decreased. To obtain the effect, it is allowable to arrange the camshaft 27 in parallel to X axis in a position far away from the powder inlet portion 20. Alternatively, the camshaft 27 can be arranged in parallel to Y axis in a position far away from the powder inlet portion 20.

Moreover, the powder housing unit (i.e., the toner collection box 14) can be used in another kind of device, in addition to a toner conveying device or an image forming apparatus, to convey any kind of powder instead of a toner.

According to an embodiment of the present invention, a gap is formed between a shaft bearing and a rotating shaft or between a plate supporting unit and a plate member on which a toner is mounted thereby allows a toner not to caught between sliding surfaces. This makes it possible to suppress a vibration and prevent noise and abnormal noise caused from the vibration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A powder housing unit comprising:

a casing configured to accommodate a powder;

an agitating unit that is arranged inside the casing and agitates the powder so that the powder evenly spreads inside the casing;

a sliding mechanism that is arranged inside the casing and causes the agitating unit to slide in a horizontal direction parallel to the agitating unit, whereby the agitating unit agitates the powder; and a suppressing member that structurally supports the sliding mechanism and suppresses noise and vibration produced when the sliding mechanism slides the agitating unit.

2. The powder housing unit according to claim 1, wherein the sliding mechanism includes a cam member; and a rotating shaft to which the cam member is attached, wherein the rotating shaft rotates while the cam member is in contact with the agitating unit thereby causing the agitating unit to slide in a substantial horizontal direction, the powder housing unit further comprising a first supporting unit that supports the rotating shaft, wherein the first supporting unit includes a first shaft bearing and a second shaft bearing that is displaced from the first shaft bearing in an axis direction of the rotating shaft.

3. The powder housing unit according to claim 2, wherein each of the first shaft bearing and the second shaft bearing is formed separately from the casing.

4. The powder housing unit according to claim 3, wherein a portion of each of the first shaft bearing and the second shaft bearing that comes in contact with the rotating shaft is made of a material having a lower coefficient-of-friction than a material of the casing.

5. The powder housing unit according to claim 3, wherein the first supporting unit is attached to the casing in a detachable manner.

6. The powder housing unit according to claim 2, wherein the casing includes a first casing member and a second casing member configured to be welded to each other, the first shaft bearing is attached to the first casing member, and the second shaft bearing is attached to the second casing member.

7. The powder housing unit according to claim 6, the first shaft bearing is arranged so as not to be in contact with the second shaft bearing.

8. The powder housing unit according to claim 6, wherein the first shaft bearing is shaped like a horseshoe and fixes a position of the rotating shaft with respect to at least one of an upward gravity direction and a horizontal direction, and the second shaft bearing has a plane surface on which the rotating shaft is mounted thereby fixing the position of the rotating shaft with respect to a downward gravity direction.

9. The powder housing unit according to claim 2, wherein the suppressing member is formed on a portion where the cam member and the agitating unit come in contact with each other.

10. The powder housing unit according to claim 9, further comprising a cam bearing that supports the cam member, wherein the suppressing member is formed on the cam bearing.

11. The powder housing unit according to claim 9, wherein the suppressing member is formed on a plane portion of the cam bearing.

12. The powder housing unit according to claim 9, wherein the suppressing member includes a slide layer and an anti-vibration layer that supports the slide layer.

13. The powder housing unit according to claim 9, wherein the cam member includes a plurality of cams having an identical eccentric phase arranged in the axis direction of the rotating shaft, at least two of the cams having a cut portion at a different phase angle.

14. The powder housing unit according to claim 9, wherein the cam member has a sharpened outer circumference.

15. The powder housing unit according to claim 9, wherein the cam member is inclined toward a plane that is orthogonal to the axis direction of the rotating shaft.

16. The powder housing unit according to claim 9, wherein the cam member is provided to the rotating shaft in a spiral shape.

17. The powder housing unit according to claim 1, further comprising a supporting plate that is formed separately from the casing, and arranged inside the casing so as to support the agitating unit from a bottom of the agitating unit.

18. An image forming apparatus comprising:

a powder housing unit that includes a casing configured to accommodate toner;

an agitating unit that is arranged inside the casing and agitates the toner so that the toner evenly spreads inside the casing;

a sliding mechanism that is arranged inside the casing and causes the agitating unit to slide in a horizontal direction parallel to the agitating unit, whereby the agitating unit agitates the powder; and a suppressing member that structurally supports the sliding mechanism and suppresses noise and vibration produced when the sliding mechanism slides the agitating unit; and a powder collecting unit that collects residual toner produced in image formation process and conveys the residual toner to the casing.

19. The image forming apparatus according to claim 18, wherein the sliding mechanism includes a cam member; and a rotating shaft to which the cam member is attached, wherein the rotating shaft rotates while the cam member is in contact with the agitating unit thereby causing the agitating unit to slide in a substantial horizontal direction, the powder housing unit further comprising a first supporting unit that supports the rotating shaft, wherein the first supporting unit includes a first shaft bearing and a second shaft bearing that is displaced from the first shaft bearing in an axis direction of the rotating shaft, and the suppressing member is formed on a portion where the cam member and the agitating unit come in contact with each other.

* * * * *